US007013986B2

(12) United States Patent
Mikiya et al.

(10) Patent No.: US 7,013,986 B2
(45) Date of Patent: Mar. 21, 2006

(54) IMPACT TOOL

(75) Inventors: Toshio Mikiya, Tokyo (JP); Yasumasa Ohki, Tokyo (JP); Yasumasa Suzuki, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 17 days.

(21) Appl. No.: 10/843,117

(22) Filed: May 11, 2004

(65) Prior Publication Data

US 2004/0226729 A1 Nov. 18, 2004

(30) Foreign Application Priority Data

May 12, 2003 (JP) ..... 2003-133165
Jul. 11, 2003 (JP) ..... 2003-273257

(51) Int. Cl.
*B25D 17/10* (2006.01)

(52) U.S. Cl. ..... 173/114; 173/51; 173/122; 173/133; 173/162.1; 173/211; 29/81.14

(58) Field of Classification Search ..... 173/210, 173/211, 132, 133, 117, 124, 51, 121, 114, 173/122, 162.1, 128; 29/81.14, 81.15, 81.16
See application file for complete search history.

(56) References Cited

U.S. PATENT DOCUMENTS 2,588,360 A * 3/1952 Cole ..... 173/76
3,150,888 A * 9/1964 Parker ..... 285/321
3,680,643 A * 8/1972 Cameron et al ..... 173/133
4,601,350 A * 7/1986 Mikiya ..... 173/117
4,632,190 A * 12/1986 Mikiya ..... 173/133
5,117,923 A * 6/1992 Wuhrer ..... 173/109
5,251,367 A * 10/1993 Ward et al. ..... 29/81.15
5,586,607 A * 12/1996 Neumaier et al. ..... 173/117
5,626,199 A * 5/1997 Henry et al. ..... 173/211
6,161,628 A * 12/2000 Liu ..... 173/168
6,631,668 B1 * 10/2003 Wilson et al. ..... 89/1.14

FOREIGN PATENT DOCUMENTS

JP H02/007026 2/1990
JP S61-007909 3/1996

* cited by examiner

*Primary Examiner*—Scott A. Smith
(74) *Attorney, Agent, or Firm*—Brinks Hofer Gilson & Lione

(57) ABSTRACT

An impact tool enables a front cover part to be easily attached to and detached from a housing body, with a device having a simplified structure. The front cover part has an annular fastening portion clamped to the outer peripheral surface of a front edge portion of the housing body, a cylindrical portion extending from the front end of the housing to the region of the fastening portion, and a connecting portion connecting together the cylindrical portion and the fastening portion. The fastening portion is split at a circumferential part thereof to form a pair of circumferentially opposing tongue-shaped portions. A clamping device is provided between the tongue-shaped portions, which is movable between a clamping position where it pulls the tongue-shaped portions toward each other and an unclamping position where the tongue-shaped portions are released from being pulled toward each other.

8 Claims, 13 Drawing Sheets

IMPACT TOOL

This application claims priority under 35 U.S.C. § 119 to Japanese Patent Application Nos. 2003-133165 filed May 12, 2003 and 2003-273257 filed Jul. 11, 2003, the entire contents of which are hereby incorporated by reference.

BACKGROUND OF THE INVENTION

The present invention relates to an impact tool having a reciprocating ram, an anvil positioned forward of the ram for receiving an impact force from the ram, a needle chisel holder for carrying a plurality of needle chisels longitudinally and movably, and for receiving the impact force from the ram through the anvil, and a cylinder that accommodates the ram, the anvil and the needle chisel holder being in coaxial alignment with one another. The impact tool is adapted to apply an impact to a workpiece by pressing the tips of the needle chisels against the surface of the workpiece.

A conventional impact tool of the type described above is provided with a grip member on the outer periphery of the cylinder, which an operator holds when carrying out an operation with the tool (for example, see Japanese Patent Application Post-Examination Publication No. Sho 41-5867). In using this conventional impact tool, however, vibrations generated in the tool are directly transmitted to the operator's hand through the grip member, which results in operator fatigue. Accordingly, impact tools designed to minimize vibrations transmitted to an operator's hand have been developed.

In one such type of impact tool, the cylinder is accommodated in a sleeve formed from an elastic material, and a grip is provided on the sleeve (for example, see Japanese Utility Model Application Post-Examination Publication No. Sho 61-7909). With this type of impact tool, however, it is difficult to accurately aim tips of needle chisels at a workpiece. Moreover, it is not possible to forcibly apply the tips of the needle chisels against the workpiece, which prevents a strong and effective impact effect from being obtained.

In another such type of impact tool, the cylinder is axially reciprocatably accommodated in a housing, with a pair of axially spaced annular spaces being formed between the outer peripheral surface of the cylinder and the inner peripheral surface of the housing. A coil spring is installed in each of the annular spaces. One end of the coil spring is engaged with the cylinder, and the other end of the coil spring is engaged with the housing, whereby axial vibrations transmitted from the cylinder to the housing are absorbed by the coil springs (for example, see Japanese Utility Model Application Post-Examination Publication No. Hei 2-7026 and Japanese Patent Application Unexamined Publication (KOKAI) No. Sho 60-180784). In using this tool, a pressing force applied by an operator to the housing is transmitted to the needle chisels through the coil springs to press the needle chisels against the workpiece during operation. However, due to the degree of rigidity that the coil springs are required to have, when the tool is used, even if when it is not in contact with the workpiece, strong vibrations are transmitted to the operator's hand.

In still another such type of impact tool, as in the case of the above-mentioned conventional impact tool, coil springs are respectively set in a pair of annular spaces. In addition, an annular elastic member is set in the front annular space; and the pair of coil springs has a small spring constant to thereby floatingly support the cylinder in the housing. The annular elastic member has a spring constant larger than that of the coil springs. When the needle chisels of the tool are pressed against a workpiece to perform a desired operation, a reaction force acting from the workpiece is therefore received by each of the annular elastic member and the coil springs (for example, see Japanese Utility Model Application Post-Examination Publication No. Sho 61-7908). In this tool, however, the annular space for providing the annular elastic member is limited in size. Therefore, the size of the annular elastic member cannot be increased, which prevents its use in an operation which requires the application of a strong force to a workpiece.

SUMMARY OF THE INVENTION

In view of the above-described drawbacks of the conventional art, an object of the present invention is to provide an impact tool wherein a cylinder accommodating an impact driving mechanism is floatingly supported in a housing by a pair of coil springs such that when the tool is operated in an unloaded state, the coil springs absorb vibrations transmitted from the cylinder to the housing, and when the tool is operated to apply an impact force to a workpiece, an adequately strong impact force can be applied to the workpiece.

An impact force is applied to the workpiece through direct contact with a plurality of needle chisels provided in the impact tool. As a result of this contact, the needle chisels readily become worn and are required to be replaced as need demands. To facilitate replacement of the needle chisels, in one type of conventional impact tool there is provided a housing comprising a front cover part and a housing body detachably connected to the rear end of the front cover part. The front cover part is detached from the housing body when the needle chisels are to be replaced (for example, see Japanese Patent Application Post-Examination Publication No. Sho 46-18706).

Another object of the present invention is to provide an impact tool that enables the front cover part to be easily attached to and detached from the housing body with a device having a simplified structure.

As stated, the present invention provides an impact tool including an impact tool assembly that has a reciprocating ram, an anvil positioned forward of the ram to receive an impact force from the ram, a needle chisel holder for carrying a plurality of needle chisels longitudinally and movably, and for receiving the impact force from the ram through the anvil, and a cylinder that accommodates the ram, the anvil and the needle chisel holder being in coaxial alignment with each other. A cylindrical housing slidably retains the impact tool assembly. The impact tool further includes a grip extending outward from one side of the housing. The grip is adapted to be held by an operator.

The cylinder has a small-diameter portion extending axially along the outer peripheral surface of the cylinder through a predetermined length. The small-diameter portion has a front end and a rear end. The cylindrical housing has a spring engaging portion provided on the inner peripheral surface thereof. The cylindrical housing is further provided with a spring retainer at its rear end.

A first coil spring is set between the front end of the small-diameter portion of the cylinder and the spring engaging portion of the cylindrical housing. A second coil spring is set between the rear end of the small-diameter portion and the spring engaging portion. The first and second coil springs floatingly support the impact tool assembly in the axial direction of the cylindrical housing.

Further, a third coil spring is set between the rear end of the impact tool assembly and the spring retainer at the rear end of the cylindrical housing. The third coil spring receives a substantial part of reaction force acting on the impact tool assembly when the tips of the needle chisels are pressed against a workpiece to perform a desired operation.

When the impact tool is driven in a state where the needle chisels are not in contact with the workpiece (unloaded state), vibrations of the needle chisels are absorbed by the first and second coil springs. Thus, vibrations transmitted to the operator's hand holding the tool are reduced to a considerable extent.

When the impact tool is operated with the needle chisels brought into contact with the workpiece (i.e. in a loaded state), the operator holding the grip applies a force to the tool in the direction of the workpiece. This causes the third coil spring to be compressed according to the force with which the grip is pushed toward the workpiece. Consequently, the third coil spring applies a pressing force to the needle chisels. Thus, the operation can be performed with a desired impact force.

Preferably, in the above-described impacting tool, the grip extends obliquely rearward from the cylindrical housing. Further, the grip is provided with an air inlet in a distal end portion thereof. The air inlet is adapted to be connected to an air hose for supply of compressed air to drive the ram of the impact tool assembly. The grip further has an air outlet for passage the compressed air, a compressed air inlet passage provided in the grip to guide compressed air supplied through the air inlet to the impact tool assembly, and an air outlet passage provided in the grip to lead compressed air having been used to drive the ram to the air outlet.

In a conventional impact tool of this type, an outlet for compressed air opens forward of the tool. Consequently, compressed air is blown onto a surface of a workpiece, resulting in dust contamination which may interfere with an operation being carried out using the tool. In the impact tool according to the present invention, the air outlet is provided at the distal end of the grip extending obliquely rearward, thereby solving the problem associated with the conventional tool.

Further, in the above-described impact tool according to the present invention, a chamber is provided between the cylinder and the needle chisel holder to receive compressed air for retracting the needle chisel holder. In addition, a pipe is integrally cast in the grip. The pipe opens at the rear end thereof into the compressed air inlet passage and extends forward therefrom. The front end portion of the pipe is communicated with the chamber. As a result of this arrangement, a reduction in weight of the impact tool can be achieved without complicating the grip structure. Further, in the above-described impact tool according to the present invention, a thermal insulating covering material, e.g. an elastomeric rubber, is provided around the grip.

When the ram is driven under expansion of compressed air supplied through its grip, the grip is subject to cooling due to adiabatic expansion of the compressed air. This cooling of the grip interferes with operation of the tool performed by an operator holding the grip of the tool with his or her hand. The thermal insulating covering material of the impact tool of the present invention solves this problem and also serves as a non-slip cover.

Further, in the impact tool according to the present invention, the outer peripheral surface of the cylinder has a small-diameter portion extending from the rear end of the cylinder toward the front end thereof, and a large-diameter portion extending forward from the small-diameter portion. The cylinder has a rear plug detachably fitted into the rear end thereof to close the rear end to form a chamber for compressed air between the rear plug and the ram.

The spring engaging portion of the housing is formed by an annular member secured to a predetermined position on the inner surface of the housing. The annular member has at the front end thereof a first spring fitting portion inserted into a rear end portion of the first coil spring to retain the rear end portion. The annular member further has at the rear end thereof a second spring fitting portion inserted into a front end portion of the second coil spring to retain the front end portion.

By the above-described arrangement, assembly of the impact tool is facilitated in that the first and second coil springs are first fitted onto the first and second spring fitting portions of the annular member, and the impact tool assembly is then inserted into the first and second coil springs. Further, in the above-described impact tool according to the present invention, the needle chisel holder is set in a distal end portion of the cylinder so as to be reciprocatable in the axial direction of the cylinder. The needle chisel holder has a large-diameter portion slidably engaged with the inner surface of the cylinder and a small-diameter portion extending forward from the large-diameter portion. A stop ring is detachably fitted to the inner surface of the distal end portion of the cylinder. The stop ring is set so as to slidably engage the outer peripheral surface of the small-diameter portion of the needle chisel holder. The stop ring cooperates with the large-diameter and small-diameter portions of the needle chisel holder and the cylinder to form a chamber for receiving compressed air to urge the needle chisel holder rearward of the cylinder. To prevent the stop ring from becoming detached from the distal end portion of the cylinder, the ring is with a split wire ring in an elastically expanded state in an annular groove formed in the inner peripheral surface of the distal end portion of the cylinder.

In a conventional impact tool of this type, the annular member has an external thread formed on the outer surface thereof, and is secured by engaging the external thread with an internal thread provided on the inner surface of the distal end portion of the cylinder. To accommodate these threads, the impact tool assembly is required to have a predetermined axial length. In the impact tool according to the present invention, since the stop ring is secured with a split wire ring, the length of the impact tool assembly can be reduced, and the center of gravity of the impact tool assembly acts closer to the grip. Accordingly, balance of the tool when held by its grip is enhanced.

In addition, the present invention provides an impact tool including a cylindrical housing with longitudinally vibratable needle chisels set in the housing so as to extend forward from an opening formed at the front end of the housing. The housing includes a front cover part extending rearward from the front end of the housing. The housing further includes a housing body detachably connected to the rear end of the front cover part, and a clamping device that clamps the front cover part to the housing body. The front cover part has an annular fastening portion that is placed on and clamped to the outer peripheral surface of the front edge portion of the housing body, and thereby connected to the outer peripheral surface. The front cover part further has a cylindrical portion extending from the front end of the housing to the region of the fastening portion, and a connecting portion connecting together the cylindrical portion and the fastening portion. The fastening portion is split at a circumferential part thereof, to thereby have a pair of tongue shaped portions opposing each other circumferentially. The clamping device is provided between the tongue-shaped portions and is movable between a clamping position where the clamping device pulls the tongue-shaped portions toward each other, and between an unclamping position where the tongue-shaped portions are released from being pulled toward each other.

In the above-described impact tool according to the present invention, the fastening portion of the front cover part is clamped to the housing body by pulling the pair of tongue-shaped portions toward one another. Accordingly, the clamping structure is kept simple, and a clamping and unclamping operation can each be easily performed. The above-described impact tool may be provided to have an arrangement as follows. The clamping device includes a lever member having a proximal end pivotally attached to the distal end of one of the tongue-shaped portions. The clamping device further includes a clamping member having a first end portion pivotally attached to the lever member at a position closer to the distal end of the lever member than the proximal end of the lever member, and a second end portion engageable with the other of the tongue-shaped portions. In the clamping position, the lever member applies tension to the clamping member in a state where the second end portion of the clamping member is engaged with the other of the tongue-shaped portions. In this position, the first end portion is located further away from the second end portion than the proximal end of the lever member; and an imaginary line connecting the first and second end portions passes radially inward of the proximal end of the lever member at the fastening portion. In the unclamping position, in a state where the second end portion of the clamping member is engaged with the other of the tongue-shaped portions, an imaginary line connecting the first and second end portions passes radially outward of the proximal end of the lever member at the fastening portion.

By the above-described arrangement, if the lever member is set in the clamping position, the tension applied to the clamping member acts to press the lever member against the front cover part. Further, the tension maintains the pulling force acting on the pair of tongue-shaped portions. Thus, the front cover part is securely clamped to the housing body. If the lever member is set in the unclamping position, the tension applied to the clamping member causes the lever member to move away from the front cover part. Hence, the first end portion of the clamping member moves closer to the other tongue-shaped portion. Consequently, the tension is canceled. Accordingly, the impact tool enables the front cover part to be connected to and disconnected from the housing body simply by pivoting the lever member between the clamping position and the unclamping position.

BRIEF DESCRIPTION OF THE DRAWINGS

The above and other objects, features and advantages of the present invention will become more apparent from the following description of the preferred embodiments thereof, taken in conjunction with the accompanying drawings.

FIG. 8(2) is a bottom view of the split wire ring.

DETAILED DESCRIPTION OF THE INVENTION

Figure 1:
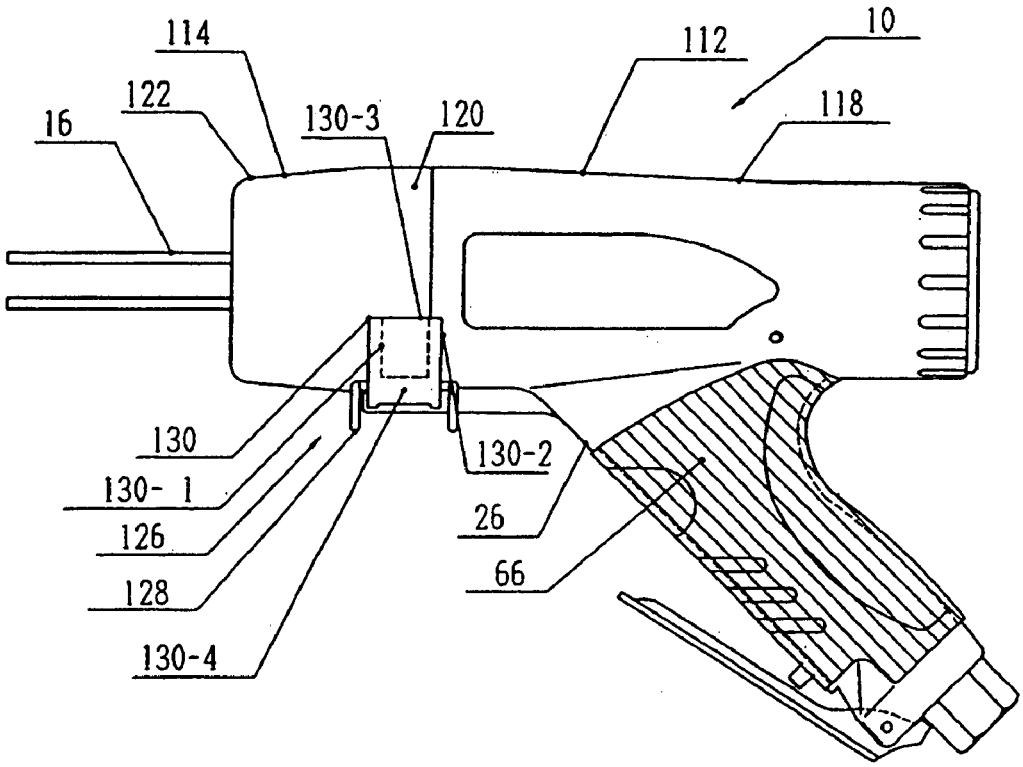
FIG. 1 is a side view of an impact tool according to the present invention.

An embodiment of the impact tool according to the present invention will be described below with reference to the accompanying drawings.

As illustrated in the drawings, an impact tool 10 according to the present invention has a housing 112 accommodating needle chisels 16 (described later), a needle chisel holder 18 (see FIG. 7), and a driving device for driving the needle chisel holder 18 in the longitudinal direction.

The housing 112 has a cylindrical shape overall. The housing 112 has a front cover part 114 extending rearward from the front end of the housing 112. A housing body 118 is detachably connected to the rear end of the front cover part 114.

Figure 5:
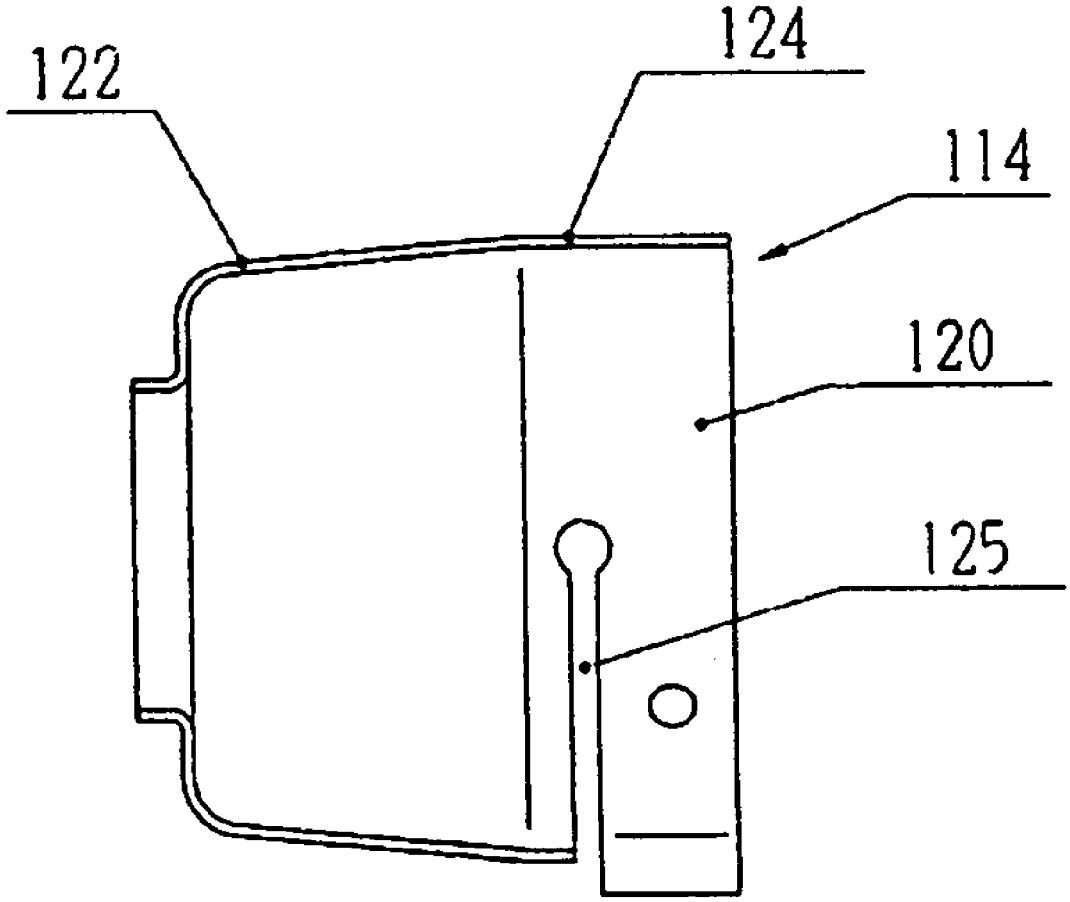
FIG. 5 is a side view of the front cover part.
Figure 6:
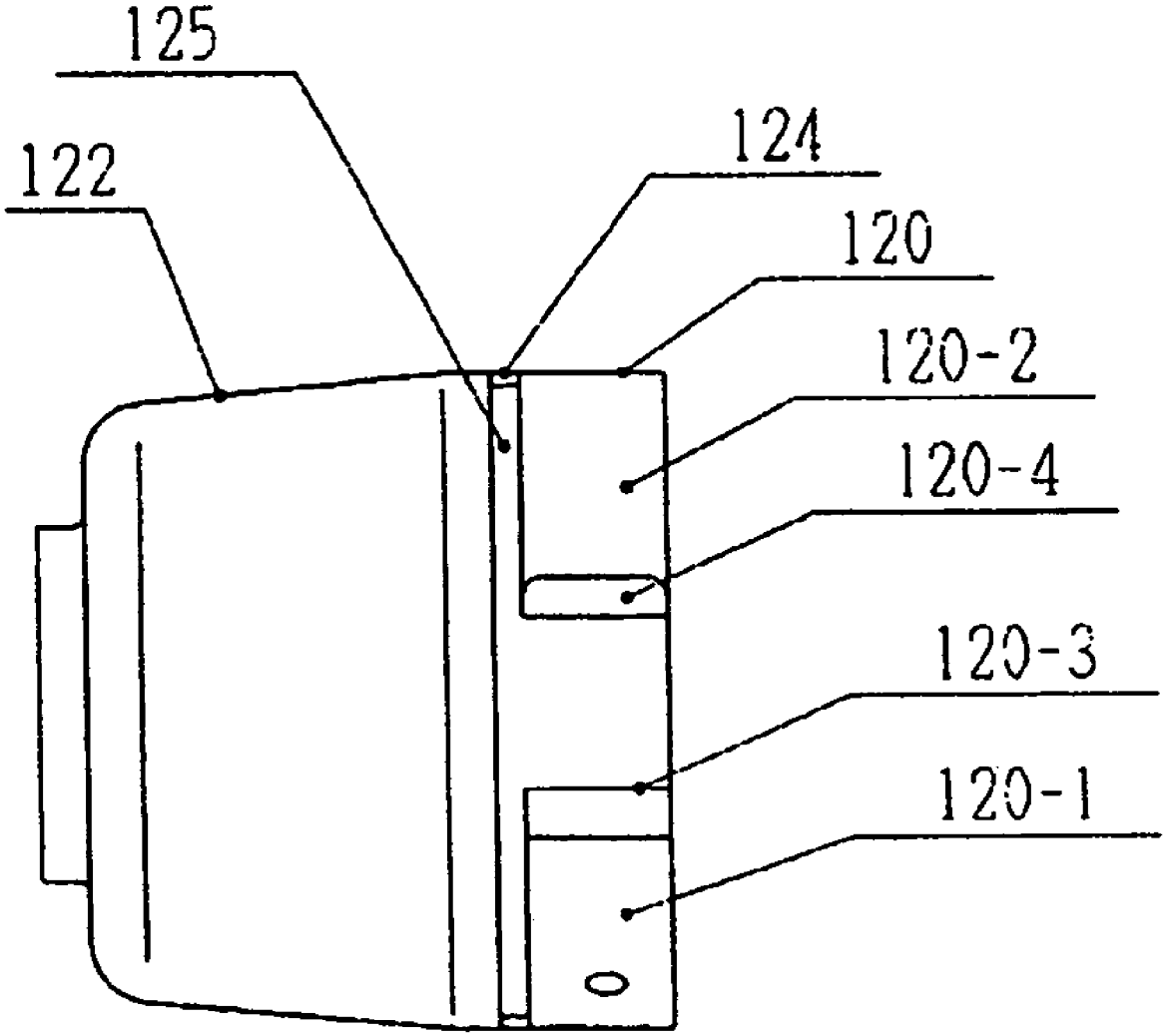
FIG. 6 is a bottom view of the front cover part.

The front cover part 114 has an annular fastening portion 120 (see FIGS. 3 to 6) that is placed on and clamped to the outer peripheral surface of a reduced-diameter front edge portion 118-1 (see FIGS. 3 and 7) of the housing body 118, and thereby connected to the outer peripheral surface. The front cover part 114 further has a cylindrical portion 122 extending from the front end of the front cover part 114 to the neighborhood of the fastening portion 120, and a connecting portion 124 (see FIGS. 5 and 6) connecting together the cylindrical portion 122 and the fastening portion 120. In the illustrated example, the connecting portion 124 extends over an angle range of approximately 180°, and a slit 125 is formed in the remaining area of the front cover part 114 on the same circumference as the connecting portion 124 over an angle range of approximately 180°. Thus, the fastening portion 120 and the cylindrical portion 122 are separated from each other by the slit 125.

At an area where the fastening portion 120 and the cylindrical portion 122 are separate from each other, the fastening portion 120 is split at a circumferential center thereof, thereby forming a pair of tongue-shaped portions 120-1 and 120-2 opposing each other circumferentially.

Figure 2:
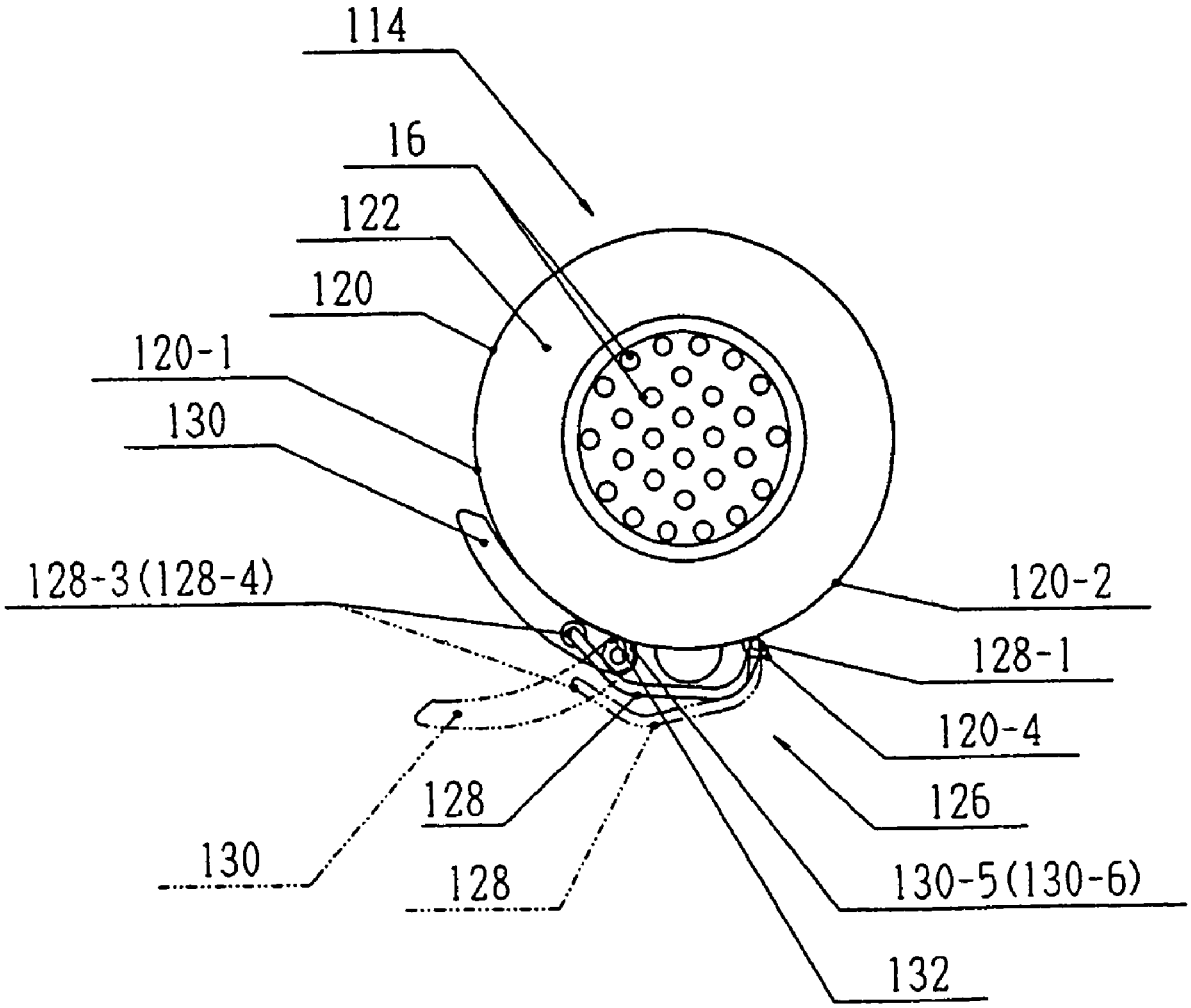
FIG. 2 is a front end view of the impacting tool.
Figure 3:
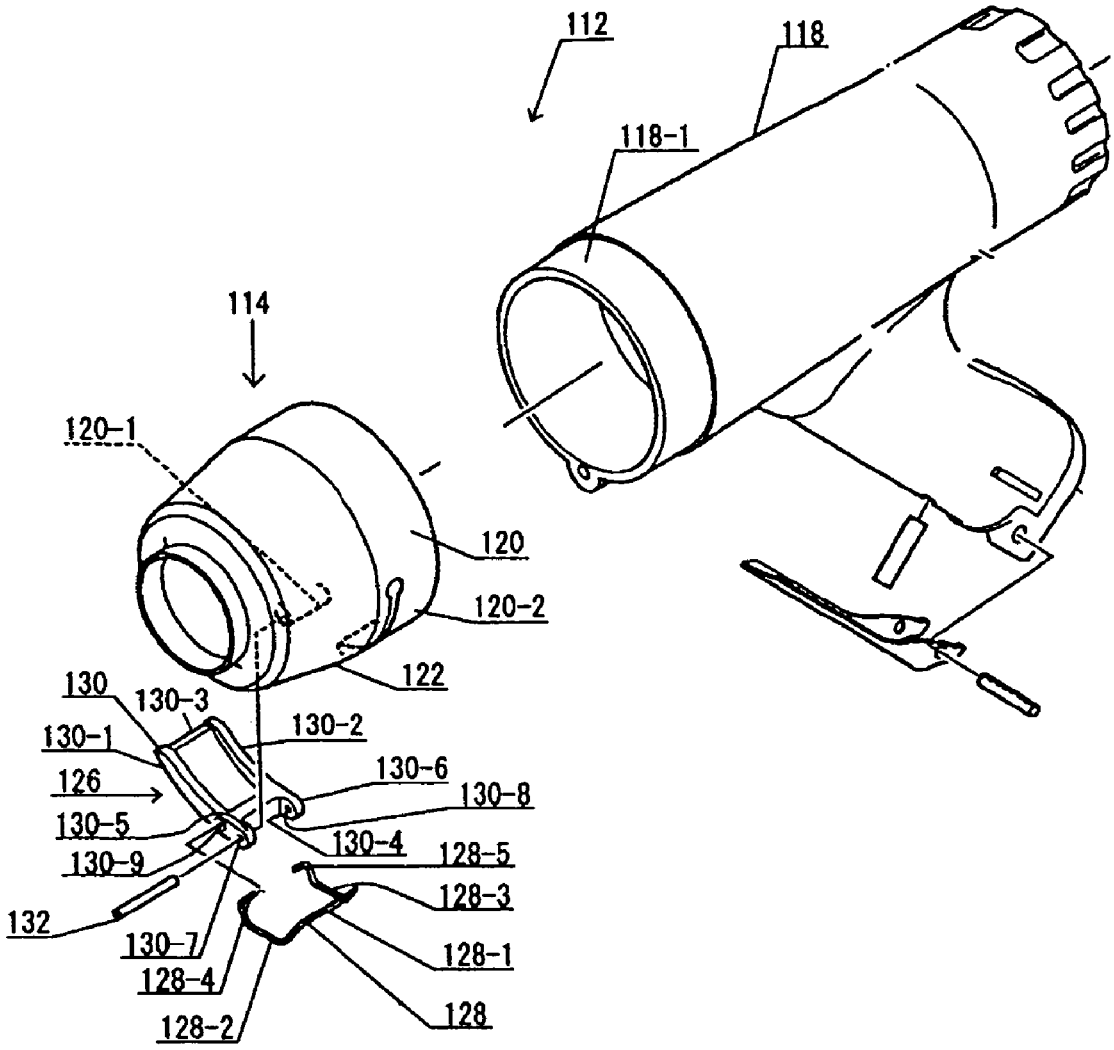
FIG. 3 is an exploded perspective view of a housing of the impacting tool.
Figure 4:
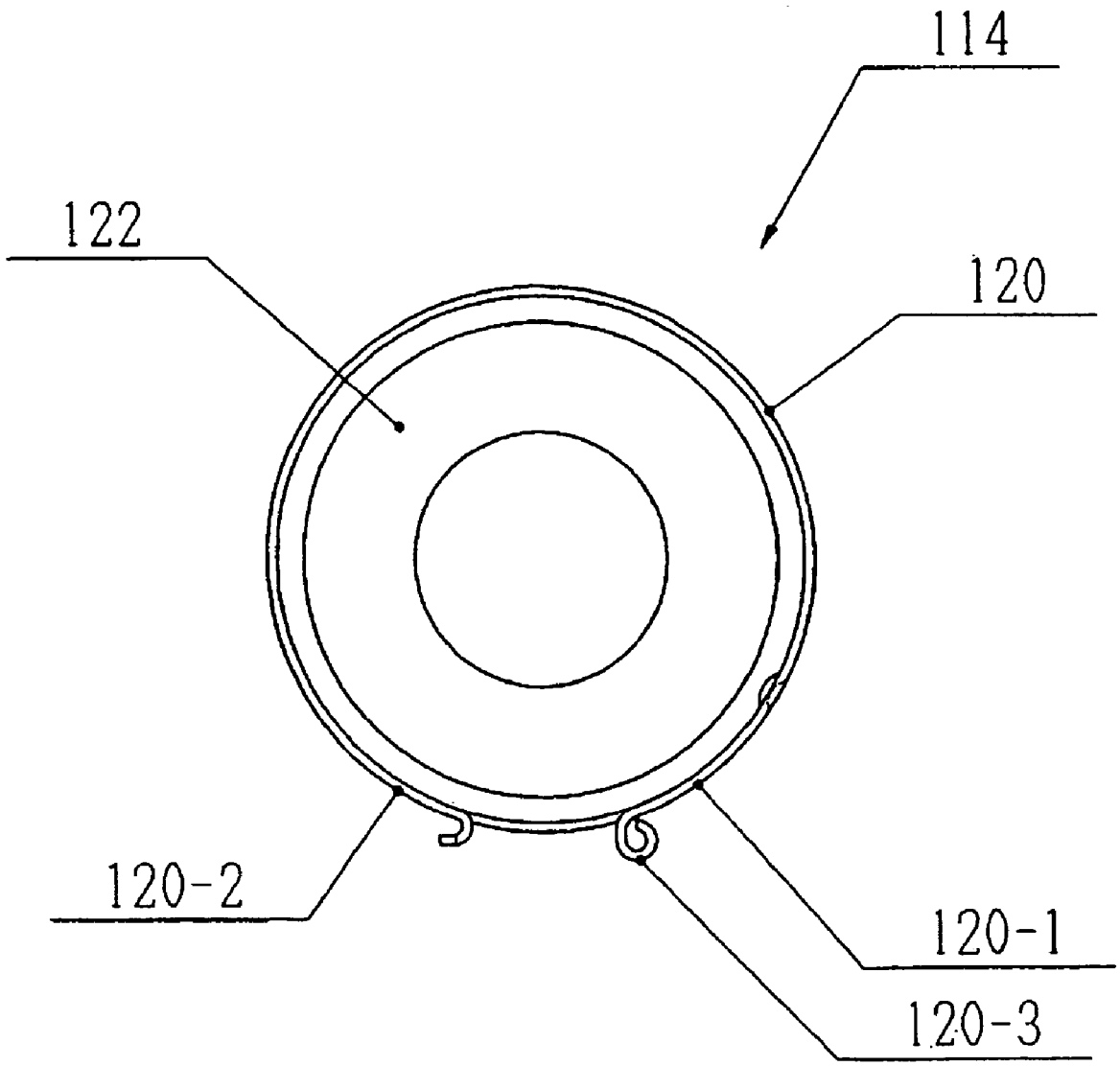
FIG. 4 is a rear end view of a front cover part of the housing.

A clamping device 126 is installed between the tongue-shaped portions 120-1 and 120-2 (see FIGS. 1 to 3). The clamping device 126 is movable between a clamping position (shown by solid lines in FIG. 2) where the clamping device 126 pulls the tongue-shaped portions 120-1 and 120-2 toward each other, and an unclamping position (shown by the chain lines in FIG. 2) where the tongue-shaped portions 120-1 and 120-2 are released from being pulled toward each other.

The clamping device 126 has a clamping member 128 and a lever member 130 for operating the clamping member 128.

The lever member 130 has the shape of a rectangle overall, and comprises left and right portions 130-1 and 130-2, and front and rear portions 130-3 and 130-4 (relative to the circumferential direction of the front cover part 114 as viewed in FIG. 3). The left and right portions 130-1 and 130-2 of the lever member 130 project rearward from the rear portion 130-4 to form projecting portions 130-5 and 130-6. The projecting portions 130-5 and 130-6 are provided with holes 130-7 and 130-8 at mutually opposing positions. A pivot shaft 132 (see FIG. 3) is inserted into a cylindrical portion 120-3 (see FIG. 4) formed by curving the distal end of one of the above-described tongue-shaped portions, i.e. the tongue-shaped portion 120-1 in the illustrated example. Both ends of the pivot shaft 132 are inserted into the holes 130-7 and 130-8, thereby enabling the lever member 130 to pivot about the pivot shaft 132. The projecting portions 130-5 and 130-6 form the "proximal end" as defined in claim 2 of this application, which is the point of pivot of the lever member 130.

The clamping member 128 comprises a central portion 128-1, and left and right portions 128-2 and 128-3 extending from the central portion 128-1, and overall has a U-shaped configuration (see FIG. 3). The distal ends of the left and right portions 128-2 and 128-3 are bent inwardly to form bent portions 128-4 and 128-5. The bent portions 128-4 and 128-5 are inserted into holes 130-9 (only one of them is shown) provided in the left and right portions 130-1 and 130-2 of the lever member 130, thereby enabling the clamping member 128 to pivot about the holes 130-9 (the bent portions 128-4 and 128-5 form the "first end portion" as defined in claims 8 and 10 of this application, which is the point of pivot of the clamping member 128, and the central portion 128-1 forms the "second end portion" as defined in the claims 8 and 10, which is the distal end of the clamping member 128).

The clamping device 126 is pivotable about the holes 130-7 and 130-8 to move between the clamping position (shown by the solid lines in FIG. 2) and the unclamping position (shown by the chain lines in FIG. 2).

In the clamping position, the central portion 128-1 of the clamping member 128, which forms the second end portion, is hooked on a curved hook portion 120-4 (see FIGS. 2 and 4) formed by curving the distal end of the tongue-shaped portion 120-2. In this state, the lever member 130 is laid over the tongue-shaped portion 120-1. In this position, tension is applied to the clamping member 128, and the bent portions 128-4 and 128-5 of the clamping member 128, which form the first end portion of the clamping member 128, are located further away from the curved hook portion 120-4 than the projecting portions 130-5 and 130-6, which form the proximal end of the lever member 130. In addition, an imaginary line connecting the bent portions 128-4 and 128-5, which form the first end portion, and the central portion 128-1, which forms the second end portion, passes radially inward of the projecting portions 130-5 and 130-6, which form the proximal end of the lever member 130, at the fastening portion 120 of the front cover part 114. Thus, the lever member 130 is held in the clamping position, thereby securely clamping the fastening portion 120 onto the outer periphery of the front end of the housing body 118.

In the unclamping position, in a state where the central portion 128-1 of the clamping member 128, which is the second end portion thereof, is hooked on the curved hook portion 120-4 of the tongue-shaped portion 120-2, an imaginary line connecting the bent portions 128-4 and 128-5, which form the first end portion, and the central portion 128-1, which forms the second end portion, passes radially outward of the proximal end of the lever member 130, i.e. the projecting portions 130-5 and 130-6, at the fastening portion 120. Accordingly, when the operator's hand is not holding the lever member 130, the lever member 130 cannot pull the clamping member 128. Thus, tension is removed from the tongue-shaped portions 120-1 and 120-2.

It should be noted that the operator can disengage the central portion 128-1 of the clamping member 128 from the curved hook portion 120-4 by pivoting the lever member 130 counterclockwise from the position shown by the chain line in FIG. 2.

Next, the internal structure of the impact tool according to the present invention will be described.

Figure 7:
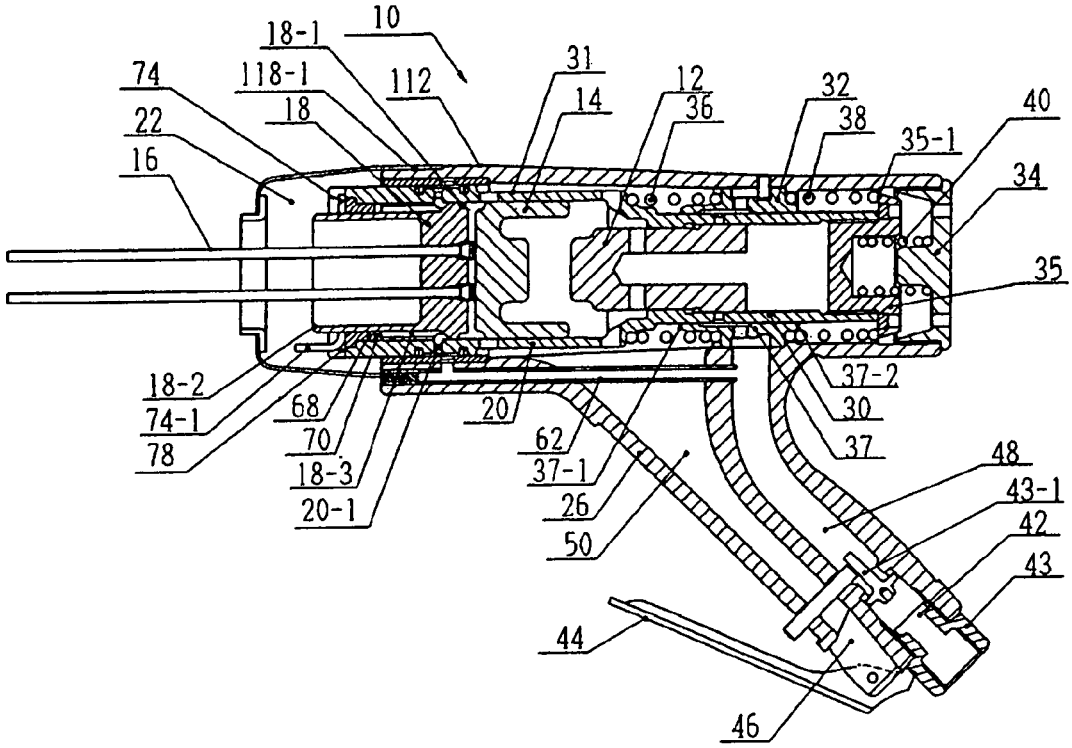
FIG. 7 is a vertical sectional view of the impact tool according to the present invention that has a ram, an anvil, a needle chisel holder and a cylinder.

As shown in FIG. 7, the impact tool 10 has an impact tool assembly 22 including a reciprocating ram 12, and an anvil 14 positioned forward (leftward in FIG. 7) of the ram 12 to receive an impact force from the ram 12. The impact tool assembly 22 further includes a needle chisel holder 18 that longitudinally and movably carries needle chisels 16, and receives the impact force from the ram 12 through the anvil 14. Further, the impact tool assembly 22 includes a cylinder 20 that accommodates the ram 12, the anvil 14 and the needle chisel holder 18 in coaxial alignment with each other.

The impact tool assembly 22 is slidably accommodated in the cylindrical housing 112. The housing 112 has a grip 26 extending obliquely rearward from the lower side of the housing 112. The grip 26 is adapted to be held by an operator.

The cylinder 20 has a small-diameter portion 30 extending axially along the outer peripheral surface of the cylinder 20 through a predetermined length. The small-diameter portion 30 has a front end and a rear end.

The cylindrical housing 112 has a spring engaging portion 32 provided on the inner peripheral surface thereof. A first coil spring 36 is set between the front end of the small-diameter portion 30 and the spring engaging portion 32 of the cylindrical housing 112, and a second coil spring 38 is set between the rear end of the small-diameter portion 30 and the spring engaging portion 32, whereby the impact tool assembly 22 is floatingly supported in the axial direction of the cylindrical housing 112. In the illustrated example, the first and second coil springs 36 and 38 have substantially the same spring constant.

In the illustrated example, the outer peripheral surface of the cylinder 20 has a small-diameter portion 30 extending from the rear end of the cylinder 20 toward the front end thereof, and a large-diameter portion 31 extending forward from the small-diameter portion 30. A rear plug 35 is threaded into the rear end of the cylinder 20. The front end of the small-diameter portion 30 is defined by the large-diameter portion 31. The rear end of the small-diameter portion 30 is defined by an annular flange 35-1 of the rear plug 35. The annular flange 35-1 extends radially outward of the rear plug 35. The spring engaging portion 32 of the cylindrical housing 112 is formed by an annular member 37 secured to a predetermined position on the inner surface of the housing 112. The annular member 37 has a first spring fitting portion 37-1 inserted into the rear end portion of the first coil spring 36 to retain the spring rear end portion. The annular member 37 further has a second spring fitting portion 37-2 inserted into the front end portion of the second coil spring 38 to retain the spring front end portion. In assembly, the first and second coil springs 36 and 38 are first fitted onto the first and second spring fitting portions 37-1 and 37-2, respectively. Then, the impact tool assembly 22 is inserted into the first and second coil springs 36 and 38. Thereafter, the rear plug 35 is threaded into the rear end of the cylinder 20 of the impact tool assembly 22. The ram 12 and the rear plug 35 form therebetween a driving chamber 52 into which compressed air is introduced to drive the ram 12 to move forward.

The cylindrical housing 112 has a spring retainer 34 threaded into the rear end thereof. A third coil spring 40 is set between the spring retainer 34 and the rear plug 35 to receive the substantial part of a reaction force acting on the impact tool assembly 22 when the tips of the needle chisels 16 are pressed against a workpiece to perform a desired operation. More specifically, the third coil spring 40 has a much larger spring constant than those of the first and second coil springs 36 and 38. The distal end of the third coil spring 40 is not in contact with the rear plug 35. Consequently, when an impacting operation is not performed, that is, when the needle chisels 16 are not pressed against a workpiece, the first and second coil springs 36 and 38 floatingly retain the cylinder 20 in the axial direction.

The distal (lower) end portion of the grip 26 is formed with an air inlet 42 supplied with compressed air for driving the ram 12 of the impact tool assembly 22 and an air outlet 46 for the compressed air. The grip 26 has formed therein a compressed air inlet passage 48 for guiding compressed air supplied through the air inlet 42 to the driving chamber 52, and an air outlet passage 50 for leading the compressed air having been used to drive the ram 12 to the air outlet 46. The air inlet 42 is provided with a connector 43 that is connected to an air hose for supplying compressed air, and is also provided with a valve 43-1 that can be either opened or closed by a lever 44.

As shown in FIG. 1, a thermal insulating covering material 66, e.g. an elastomeric rubber, is provided around the grip 26 to allow the operator to hold the grip 26 comfortably even when the grip 26 is caused to cool by adiabatic expansion of the compressed air.

The needle chisel holder 18 has a large-diameter portion 18-1 slidably engaged with the inner surface of the cylinder 20, and a small-diameter portion 18-2 extending forward from the large-diameter portion 18-1. A stop ring 68 is detachably attached to the inner surface of the distal end portion of the cylinder 20. The stop ring 68 is set so as to slidably engage the outer peripheral surface of the small-diameter portion 18-2 of the needle chisel holder 18. The stop ring 68 cooperates with the large-diameter portion 18-1 and the small-diameter portion 18-2 of the needle chisel holder 18 and the cylinder 20 to form a chamber 70 for receiving compressed air to urge the needle chisel holder 18 rearward of the cylinder 20.

Figure 8:
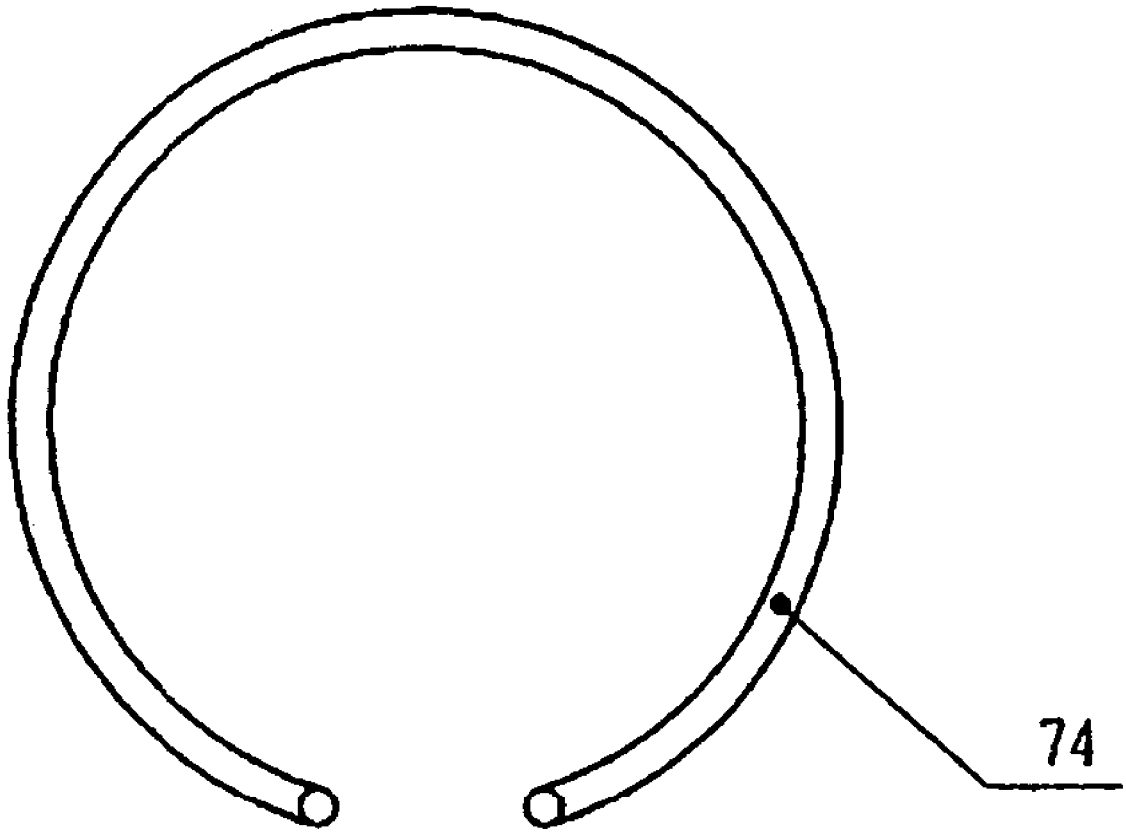
FIG. 8(1) is a front view of a split wire ring for securing a stop ring to the distal end of the cylinder.
Figure 8:
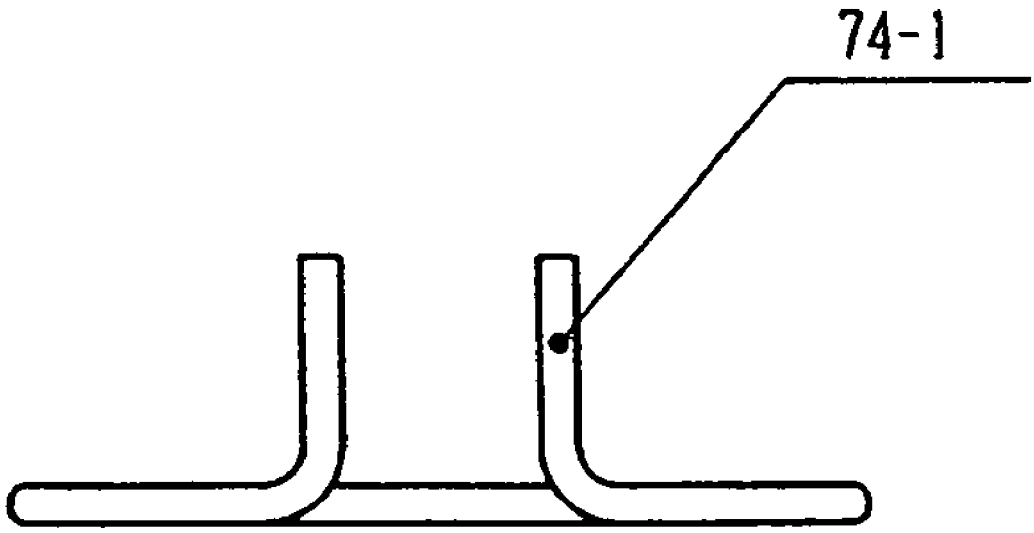

As will be understood from FIGS. 7, 8(1) and 8(2), the stop ring 68 is secured so as to be immovable in the axial direction relative to the distal end of the cylinder 20 by a split wire ring 74 set in an elastically expanded state in an annular groove 78 formed in the inner surface of the distal end portion of the cylinder 20. To set the split wire ring 74, the stop ring 68 is fitted into the cylinder 20. Then, the split wire ring 74 is inserted into the cylinder 20 from the opening at the distal end thereof by pulling lugs 74-1 of the split wire ring 74 toward each other to thereby reduce the diameter of the split wire ring 74. When the split wire ring 74 has reached a position corresponding to the groove 78 provided in the inner surface of the cylinder 20, the lugs 74-1 of the split wire ring 74 are released to allow them to move away from each other, thereby enlarging the diameter of the split wire ring 74 so that it is fitted into the groove 78 of the cylinder 20. The lower portion (as viewed in FIG. 7) of the distal end of the cylinder 20 is provided with a cut portion extending from the distal end to the groove 78 to allow the split wire ring 74 to expand so as to be set in position after the lugs 74-1 of the split wire ring 74 have been inserted from the cylinder distal end as far as the groove 78. In the illustrated example, another cut portion is provided in the upper portion (as viewed in FIG. 7) at the distal end of the cylinder 20 to allow the cylinder 20 to be held with a tool when the cylinder 20 is inserted and set in the housing 112.

The grip 26 has a pipe 62 integrally cast therein. The rear end of the pipe 62 opens into the compressed air inlet passage 48 in the grip 26. The pipe 62 extends forward from the compressed air inlet passage 48. The front end portion of the pipe 62 communicates with the chamber 70 through a radial passage 20-1 provided in the cylinder distal end portion and an axial passage 18-3 provided on the needle chisel holder 18. In the illustrated example, the front end of the pipe 62 is closed, but a hole is provided in a side wall of the pipe 62 adjacent to the front end thereof. The hole provides communication between the pipe 62 and the radial passage 20-1.

Next, the operation of the above-described impact tool will be described.

Figure 9:
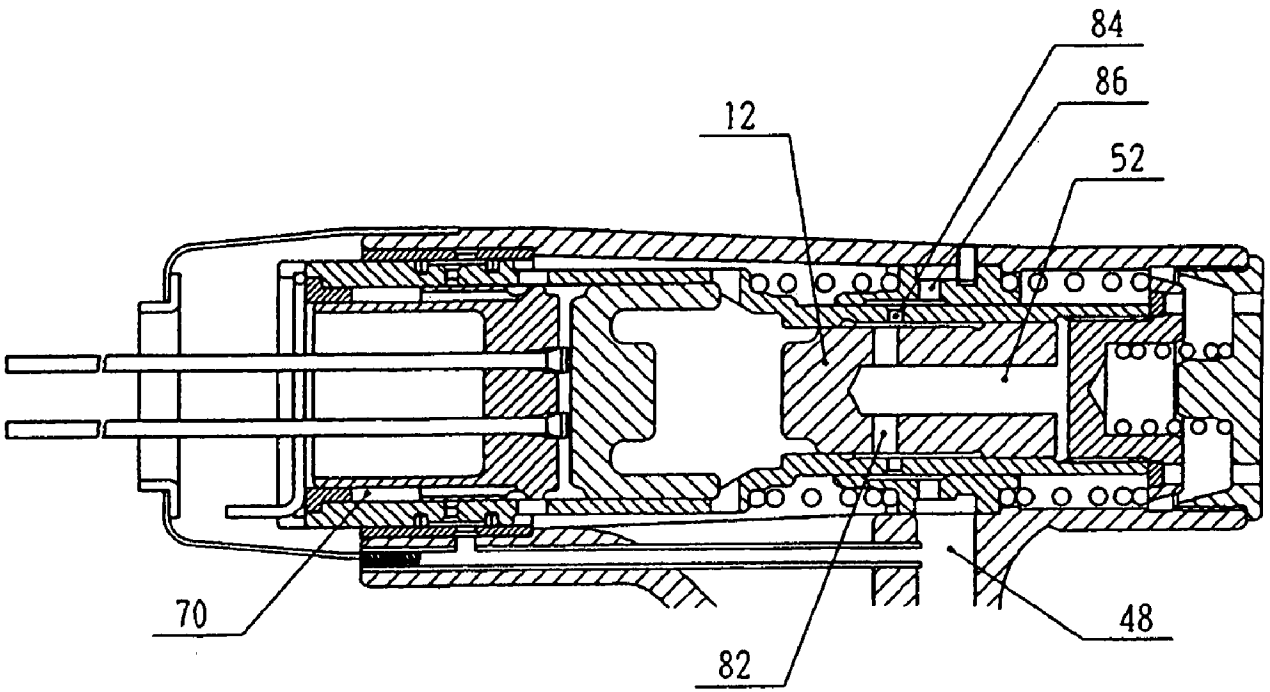
FIG. 9 is a sectional view showing the impact tool in a state where the ram begins an impacting action.

FIG. 9 shows the impact tool in a state where the ram 12 is located in a position where compressed air is introduced into the driving chamber 52 (i.e. a state where the ram 12 begins an impacting action by being driven to advance). That is, the ram 12 has a compressed air inlet 82 in the side wall thereof. In the state shown in FIG. 9, the compressed air inlet 82 is in communication with a compressed air hole 84 provided in the side wall of the cylinder 20 to communicate with the upper end of the compressed air inlet passage 48 in the grip 26. Consequently, compressed air is introduced into the driving chamber 52, and the ram 12 is rapidly driven forward by the compressed air. In the illustrated example, the compressed air hole 84 formed in the cylinder 20 is communicated with the compressed air inlet passage 48 through a radial passage 86 extending through an approximately central portion of the annular member 32 that retains the first and second coil springs 36 and 38.

Figure 10:
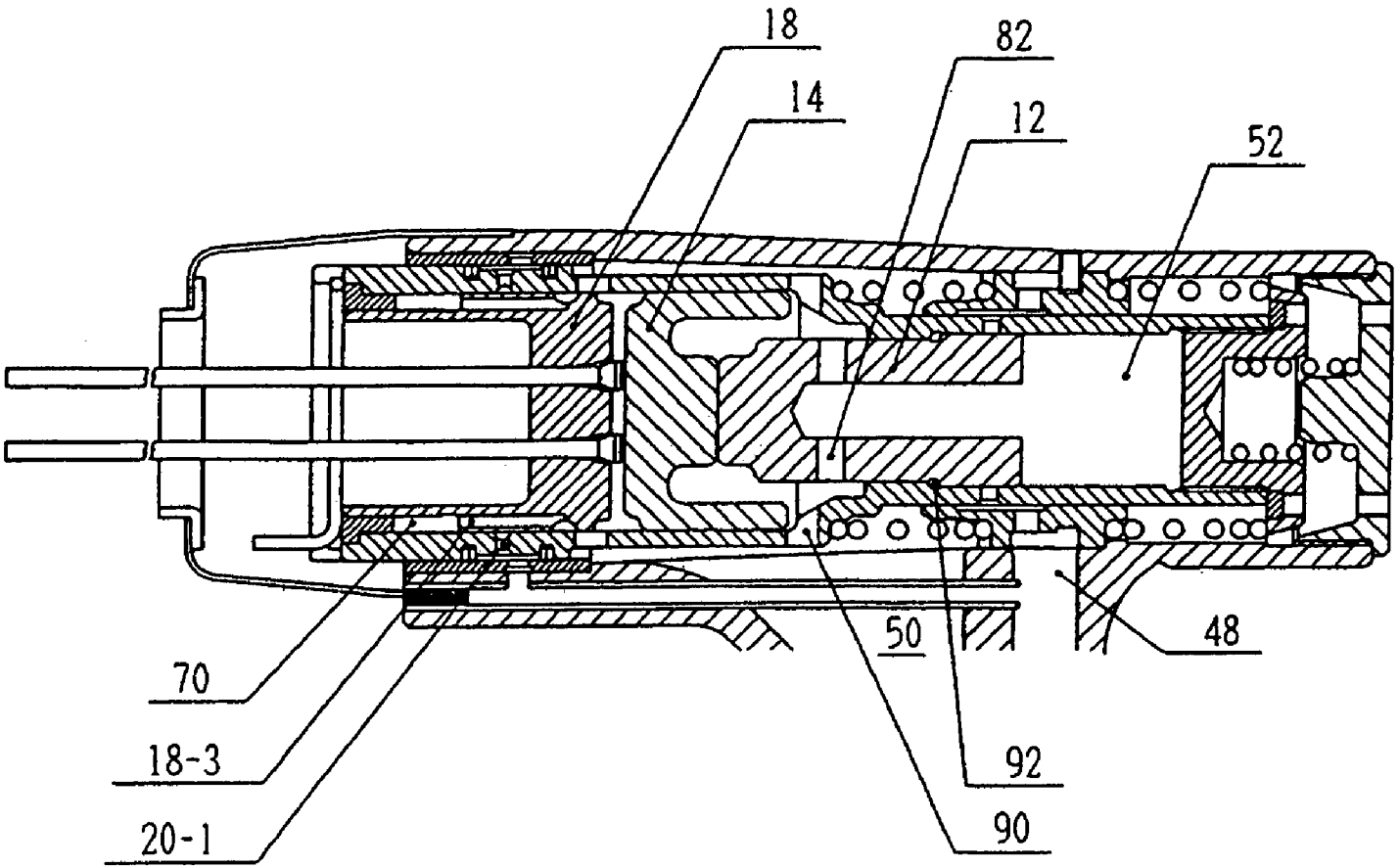
FIG. 10 is a sectional view showing the impact tool in a state where the ram has struck the anvil.

FIG. 10 shows a state where the ram 12 has been rapidly driven forward by the compressed air introduced into the driving chamber 52 to impact against the anvil 14, thereby applying a forward impact to the anvil 14 and the needle chisel holder 18, which is in contact with the anvil 14. In this state, the compressed air inlet 82 in the ram 12 is in communication with an exhaust passage 90 extending through the side wall of the cylinder 20, so that the compressed air introduced into the driving chamber 52 is discharged to the air outlet passage 50 through the exhaust passage 90.

Figure 11:
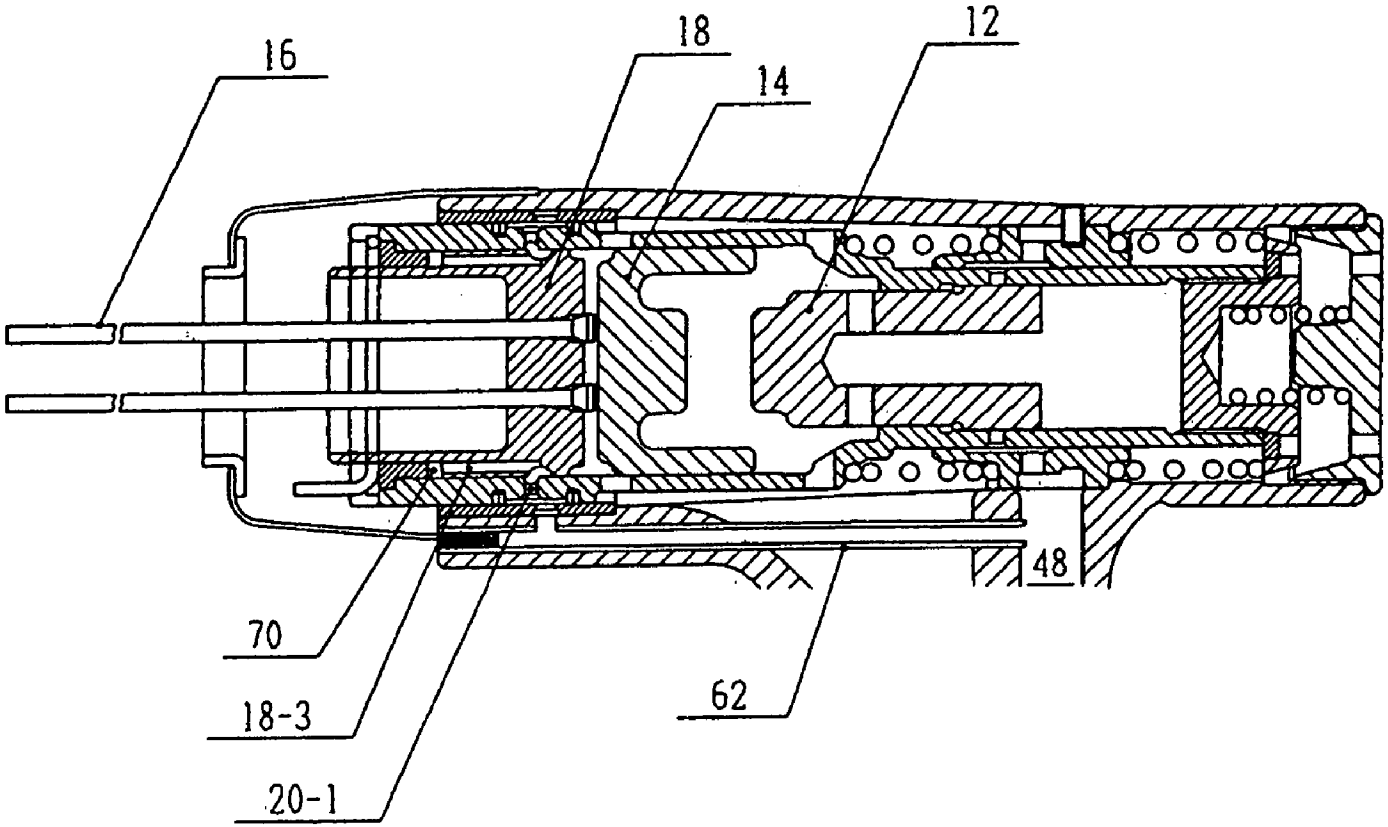
FIG. 11 is a sectional view showing the impact tool in a state where the anvil and the needle chisel holder have advanced.

FIG. 11 shows a state where the anvil 14 and the needle chisel holder 18 have been advanced by the impact applied thereto from the ram 12 shown in FIG. 10, and are separate from the ram 12. It will be understood that the chamber 70 into which compressed air for pushing back the needle chisel holder 18 rearward is introduced is caused to contract under advancement of the needle chisel holder 18. In this state, the rear end opening of the axial passage 18-3 formed on the needle chisel holder 18 is in communication with the radial passage 20-1 in the cylinder distal end portion, which is in communication with the pipe 62. Consequently, compressed air is introduced into the chamber 70. Thus, a push-back force is applied to the needle chisel holder 18.

Figure 12:
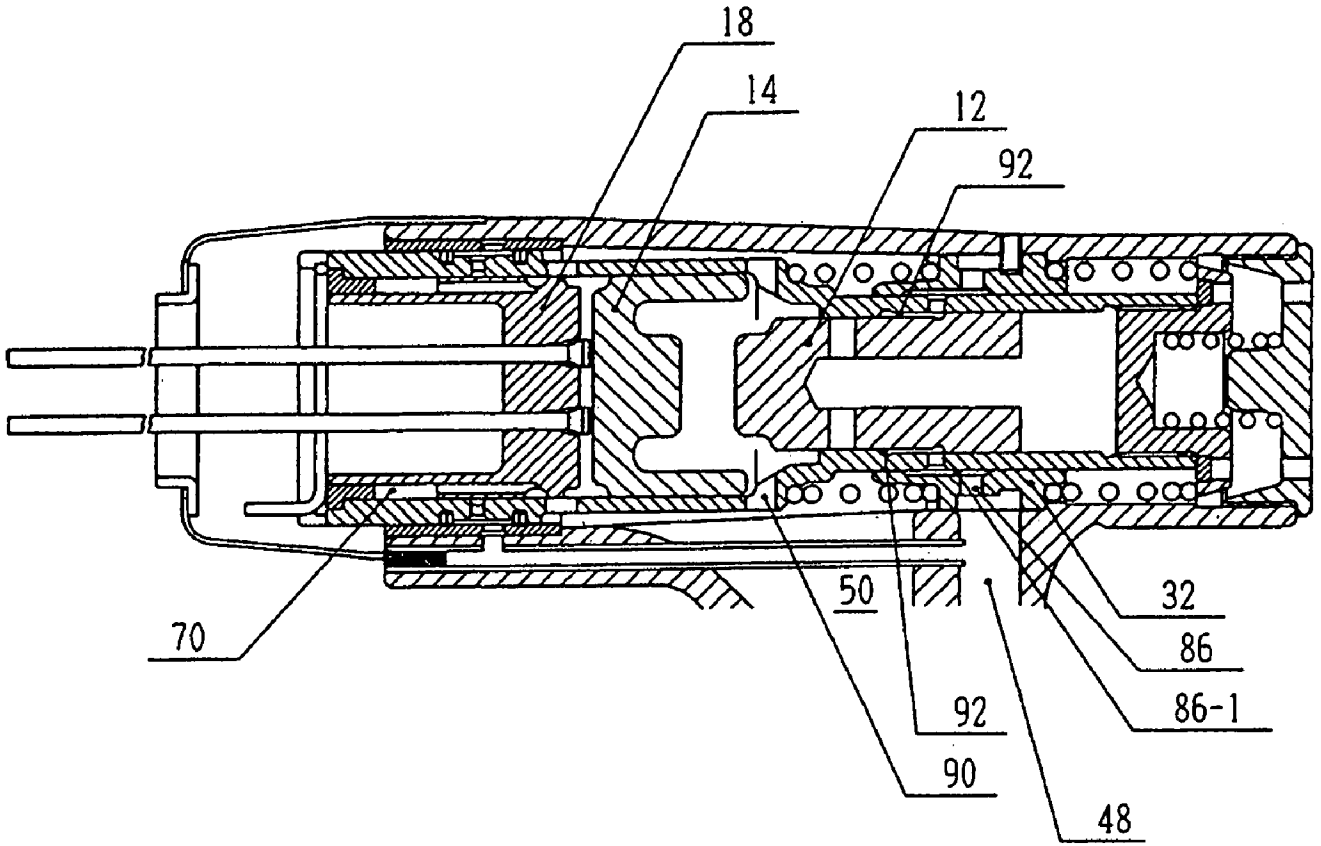
FIG. 12 is a sectional view showing the impact tool in a state where the anvil and the needle chisel holder have been pushed back, and consequently, the ram has begun retracting.

FIG. 12 shows a state where the needle chisel holder 18 and the anvil 14 have been pushed back rearward by the push-back force from the chamber 70, and consequently, the ram 12 has been pushed back rearward. In this state, the compressed air inlet passage 48 is communicated with an annular space 92 formed between the inner peripheral surface of the cylinder 20 and the outer peripheral surface of the ram 12, and a rearward driving force is acting on the ram 12. Thus, the ram 12 is returned to the position shown in FIG. 9. It should be noted that the inner peripheral surface of the annular member 32 is formed with an axially extending groove 86-1 communicating with the radial passage 86 provided in the annular member 32. The radial passage 86 is in communication with the compressed air hole 84 of the cylinder 20 through the groove 86-1. This allows the compressed air hole 84 provided in the cylinder 20 to maintain communication with the compressed air inlet passage 48 in the grip 26 through the groove 86-1 and the radial passage 86 even when the cylinder 20 is axially displaced during the impacting operation.

It should be noted that the present invention is not necessarily limited to the foregoing embodiment but can be modified in a variety of ways without departing from the gist of the present invention.

What is claimed is:

1. An impact tool comprising:

an impact tool assembly including a reciprocating ram, an anvil positioned forward of said ram to receive an impact force from said ram, a needle chisel holder for carrying needle chisels longitudinally and movably, and for receiving the impact force from said ram through said anvil, and a cylinder that accommodates said ram, anvil and needle chisel holder in coaxial alignment with one another;

a cylindrical housing slidably retaining said impact tool assembly; and a grip extending outward from one side of said housing, said grip being adapted to be held by an operator; wherein said cylinder has a small-diameter portion extending axially along an outer peripheral surface of said cylinder through a predetermined length, said small-diameter portion having a front end and a rear end, said cylindrical housing having a spring engaging portion provided on an inner peripheral surface thereof, said cylindrical housing further having a spring retainer provided at a rear end thereof, wherein a first coil spring is set between the front end of said small-diameter portion of said cylinder and the spring engaging portion of said cylindrical housing, and a second coil spring is set between the rear end of said small-diameter portion and said spring engaging portion, and a third coil spring is set between a rear end of said impact tool assembly and the spring retainer at the rear end of said cylindrical housing, said first and second coil springs being adapted to floatingly support said impact tool assembly in an axial direction of said cylindrical housing, said third coil spring being adapted to receive a substantial part of reaction force acting on said impact tool assembly when tips of the needle chisels are pressed against a workpiece to perform a desired operation.

2. An impact tool according to claim 1, wherein said grip extends obliquely rearward from said cylindrical housing, said grip having:

an air inlet provided in a distal end portion of said grip, said air inlet being adapted to be connected to an air hose for supplying compressed air to drive the ram of said impact tool assembly, and an air outlet for the compressed air; and a compressed air inlet passage provided in said grip to guide compressed air supplied through said air inlet to said impact tool assembly, and an air outlet passage provided in said grip to lead compressed air having been used to drive said ram to said air outlet.

3. An impact tool according to claim 2, wherein a chamber is provided between said cylinder and said needle chisel holder to receive compressed air for retracting said needle chisel holder, and a pipe is integrally cast in said grip, said pipe opening at a rear end thereof into said compressed air inlet passage and extending forward therefrom, said pipe being communicated with said chamber at a front end portion thereof.

4. An impact tool according to claim 1, wherein a thermal insulating covering material is provided around said grip.

5. An impact tool according to claim 1, wherein the outer peripheral surface of said cylinder has a small-diameter portion extending from a rear end of said cylinder toward a front end thereof, and a large-diameter portion extending forward from said small-diameter portion, and said cylinder has a rear plug detachably fitted into the rear end thereof to close said rear end to form a compressed air chamber between said rear plug and said ram, said spring engaging portion of said housing being formed by an annular member secured to a predetermined position on an inner surface of said housing, said annular member having at a front end thereof a first spring fitting portion inserted into a rear end portion of said first coil spring to retain said rear end portion, said annular member further having at a rear end thereof a second spring fitting portion inserted into a front end portion of said second coil spring to retain said front end portion.

6. An impact tool according to claim 1, wherein said needle chisel holder is set in a distal end portion of said cylinder so as to be reciprocatable in the axial direction of said cylinder, said needle chisel holder having a large-diameter portion slidably engaged with an inner surface of said cylinder and a small-diameter portion extending forward from said large-diameter portion, wherein a stop ring is detachably fitted to an inner surface of the distal end portion of said cylinder, said stop ring being set so as to slidably engage an outer peripheral surface of the small-diameter portion of said needle chisel holder, said stop ring cooperating with the large-diameter portion and the small-diameter portion of said needle chisel holder and said cylinder to form a chamber for receiving compressed air to urge said needle chisel holder rearward of said cylinder, said stop ring being secured to the distal end portion of said cylinder so as to be immovable in the axial direction by a split wire ring set in an elastically expanded state in an annular groove formed in the inner peripheral surface of the distal end portion of said cylinder.

7. An impact tool according to claim 1, wherein said housing includes:

a front cover part extending rearward from the front end of said housing;

a housing body detachably connected to a rear end of said front cover part; and a clamping device that clamps said front cover part to said housing body;

said front cover part having:

an annular fastening portion placed on and clamped to an outer peripheral surface of a front edge portion of said housing body, thereby being connected to said outer peripheral surface;

a cylindrical portion extending from the front end of said housing to a neighborhood of said fastening portion; and a connecting portion connecting together said cylindrical portion and said fastening portion;

said annular fastening portion being split at a circumferential part thereof, thereby having a pair of tongue-shaped portions opposing each other circumferentially;

said clamping device being provided between said tongue-shaped portions and movable between a clamping position where said clamping device pulls said tongue-shaped portions toward each other and an unclamping position where said tongue-shaped portions are released from being pulled toward each other.

8. An impact tool according to claim 7, wherein said clamping device includes:

a lever member having a proximal end pivotally attached to a distal end of one of said tongue-shaped portions; and a clamping member having a first end portion pivotally attached to said lever member at a position closer to a distal end of said lever member than the proximal end of said lever member, and a second end portion engageable with the other of said tongue-shaped portions;

wherein, in said clamping position, said lever member applies tension to said clamping member in a state where the second end portion of said clamping member is engaged with said other of said tongue-shaped portions, wherein said first end portion is located further away from said second end portion than the proximal end of said lever member, and an imaginary line connecting said first and second end portions passes radially inward of the proximal end of said lever member at said fastening portion, whereas in said unclamping position, in a state where the second end portion of said clamping member is engaged with said the other of said tongue-shaped portions, an imaginary line connecting said first and second end portions passes radially outward of said proximal end at said fastening portion.

* * * * *